US007334696B2

(12) United States Patent
Tanaka et al.

(10) Patent No.: US 7,334,696 B2
(45) Date of Patent: Feb. 26, 2008

(54) SQUARE SECTIONED SYNTHETIC RESIN CONTAINER

(75) Inventors: Toshimasa Tanaka, Koto-ku (JP); Takao Iizuka, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 58 days.

(21) Appl. No.: 10/518,487

(22) PCT Filed: Jun. 23, 2003

(86) PCT No.: PCT/JP03/07933

§ 371 (c)(1),
(2), (4) Date: Aug. 17, 2005

(87) PCT Pub. No.: WO04/000662

PCT Pub. Date: Dec. 31, 2003

(65) Prior Publication Data

US 2006/0108317 A1 May 25, 2006

(30) Foreign Application Priority Data

Jun. 21, 2002 (JP) ..... 2002-181356

(51) Int. Cl.
*B65D 1/00* (2006.01)
*B65D 1/46* (2006.01)

(52) U.S. Cl. ..... 215/383; 215/382; 220/672; 220/675

(58) Field of Classification Search ..... 215/379–383, 215/384; 220/669, 672, 675
See application file for complete search history.

(56) References Cited

U.S. PATENT DOCUMENTS

| | | | | | |
|---|---|---|---|---|---|
| 3,536,500 | A | * | 10/1970 | Cleereman et al. | 426/130 |
| 3,537,498 | A | * | 11/1970 | Amand | 604/403 |
| 3,708,082 | A | * | 1/1973 | Platte | 215/385 |
| 5,224,614 | A | * | 7/1993 | Bono et al. | 215/384 |
| 5,350,078 | A | * | 9/1994 | Potts et al. | 215/384 |
| 6,068,161 | A | * | 5/2000 | Soehnlen et al. | 222/143 |
| 6,161,713 | A | * | 12/2000 | Krich | 215/384 |
| 6,695,162 | B1 | * | 2/2004 | Boukobza et al. | 215/384 |
| 2003/0010743 | A1 | * | 1/2003 | Boukobza | 215/382 |

FOREIGN PATENT DOCUMENTS

| | | | |
|---|---|---|---|
| JP | A-58-074325 | | 5/1983 |
| JP | U 2-102316 | | 8/1990 |
| JP | A-10-305823 | | 11/1998 |
| JP | A 2000-25733 | | 1/2000 |
| JP | 2002145233 | A * | 5/2002 |

* cited by examiner

*Primary Examiner*—Sue A. Weaver
(74) *Attorney, Agent, or Firm*—Oliff & Berridge PLC

(57) ABSTRACT

A square-sectioned synthetic resin container includes a body having a square cross-section defined by four cornered pillar portions and four flat walls joining the adjacent pillars, wherein the body is provided with a waist for dividing the body at least into upper and lower sections. According to the present invention, the waist is formed by a circumferential groove having a profile that protrudes convexly inwards of the container. The groove has an arcuate groove wall with a constant radius of curvature, at least at the pillar portion.

8 Claims, 6 Drawing Sheets

SQUARE SECTIONED SYNTHETIC RESIN CONTAINER

BACKGROUND OF THE INVENTION

1. Technical Field

The present invention relates to a square-sectioned synthetic resin container, particularly to such a container capable of effectively compensating for lowering of the strength due to the reduction of the container wall thickness.

2. Background Art

Recently, containers made of synthetic resin ("synthetic resin containers") as represented by PET bottles are widely used as storage for food, beverages, cosmetics, medicines or the like. This is because synthetic resin containers are light in weight and easy to handle, and preserve transparency to exhibit refined appearance comparable with glass bottles, besides that they can be produced at relatively low cost.

Synthetic resin container has relatively low mechanical strength against external force so that, for example, if one holds the body of the container by hand for pouring out its contents, the body part held by hand readily undergoes deformation. Thus, for this type of synthetic resin container, in order to improve the mechanical resistance (buckling strength, rigidity, etc.) against external forces, it is customary to suitably adjust the container wall thickness and provide lengthwise or crosswise ribs around the body, or to inscribe a narrow groove (waist) having an inwardly projecting trapezoidal profile around the body.

From the viewpoint of effective use of natural resources and reduction of wastes, there is recently an increasing demand for reducing the amount of resin used for one container, by reducing the wall thickness (or the weight) of the container. In order to satisfy such demand, it would be inevitable for the synthetic resin containers to have a reduced strength. Specifically, in the case of a waist-inscribed synthetic resin container having a square cross-section, there is often adopted an arrangement wherein the depth of the waist groove at the pillar portions is made smaller than the depth of the grooves at the wall portions, in consideration of buckling. Despite such an arrangement, however, if a load is applied onto the container from the top portion downwards, stresses tend to concentrate at the groove portions inscribed on the pillar portions (i.e., at the corner portions of the container). Such stress concentration is marked particularly at the joint of the surfaces where the waist is inflected to project convexly inwards of the container, thereby causing buckling of the container starting from the joint in question, and an effective solution of such problem is therefore highly demanded.

DISCLOSURE OF THE INVENTION

It is an object of the present invention to prevent bucking of the container starting from the waist at the pillar portion, which had been observed in square-sectioned synthetic resin containers.

According to the present invention, there is provided a square-sectioned synthetic resin container comprising a body having a square cross-section defined by four corner pillar portions and four flat walls joining the adjacent pillar portions, said body being provided with a waist for dividing the body into at least upper and lower sections, wherein:

the waist comprises a circumferential groove having a trapezoidal profile that protrudes convexly inwards of the container; and the groove has an arcuate groove wall at least at said pillar portion.

It is preferred that the arcuate profile of the groove wall according to the present invention has a constant radius of curvature R.

Furthermore, it is preferred that the pillar portion according to the present invention has an inflection at a transition to the waist, wherein the inflection has an arcuate profile that projects convexly outwards.

BRIEF DESCRIPTION OF THE DRAWINGS

The present invention will be more fully described below with reference to the accompanying drawings.

BEST MODE FOR CARRYING OUT THE INVENTION

Figure 1:
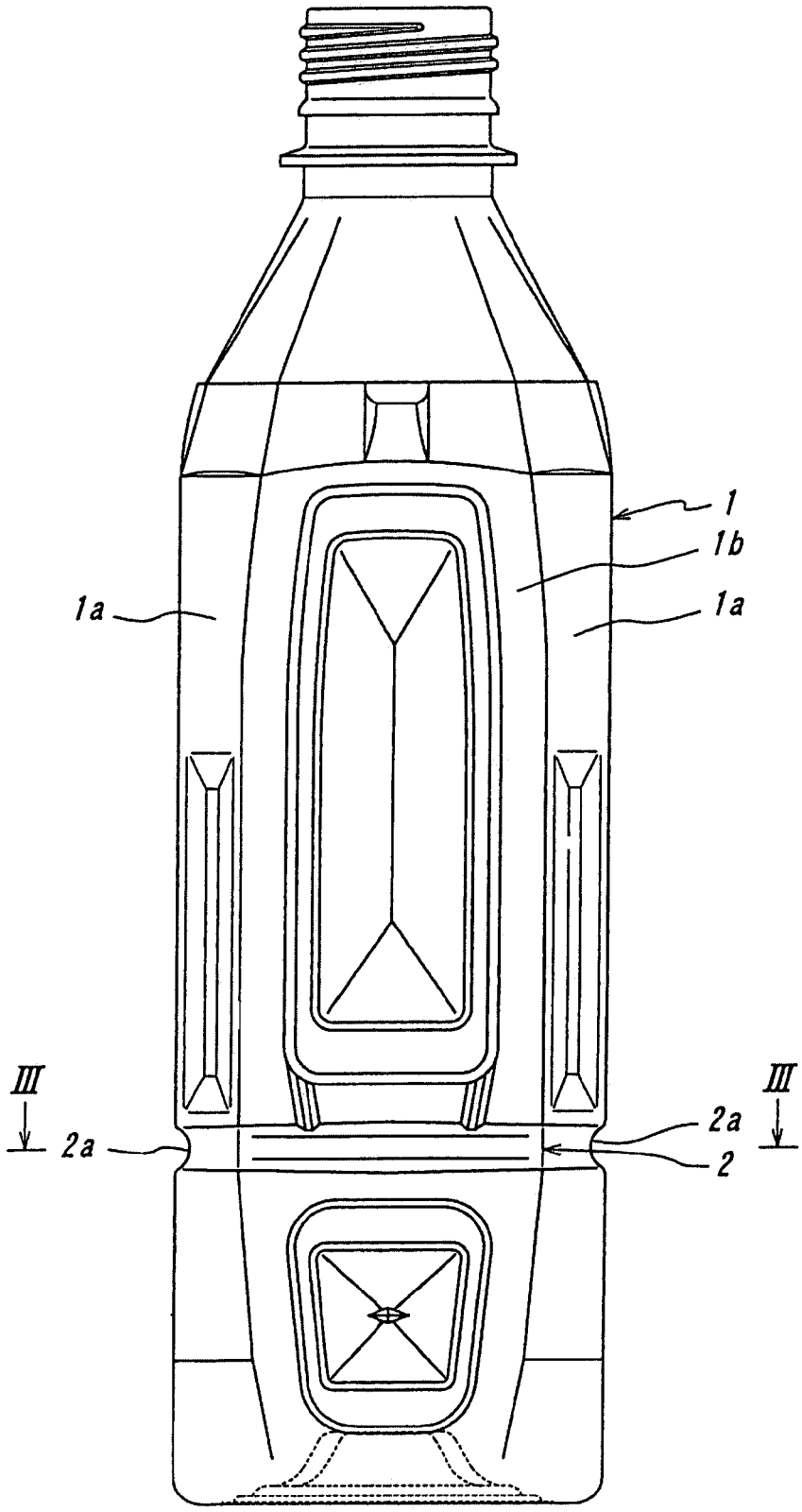
FIG. 1 is a side view of a square-sectioned container according to the present invention.
Figure 2:
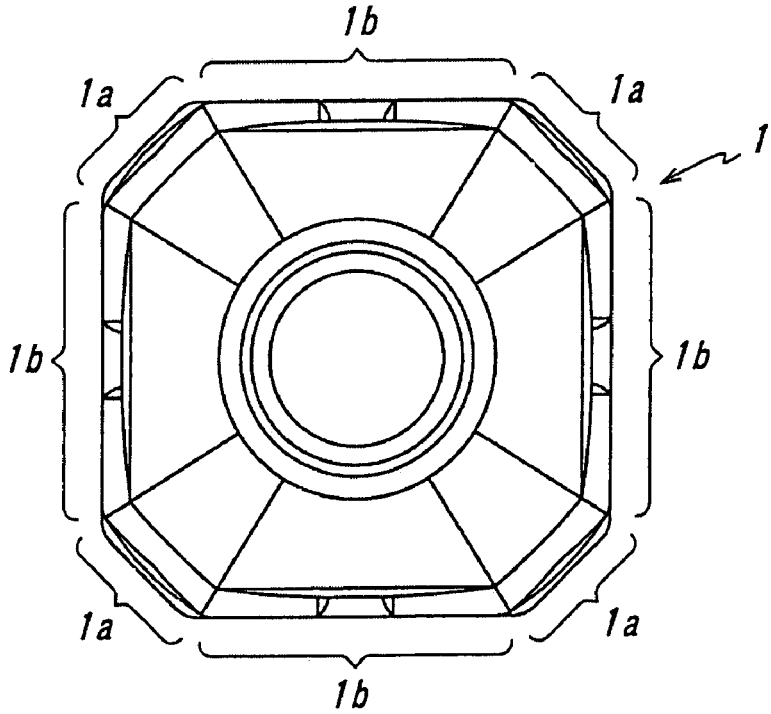
FIG. 2 is a top plan view of the container shown in FIG. 1.
Figure 3:
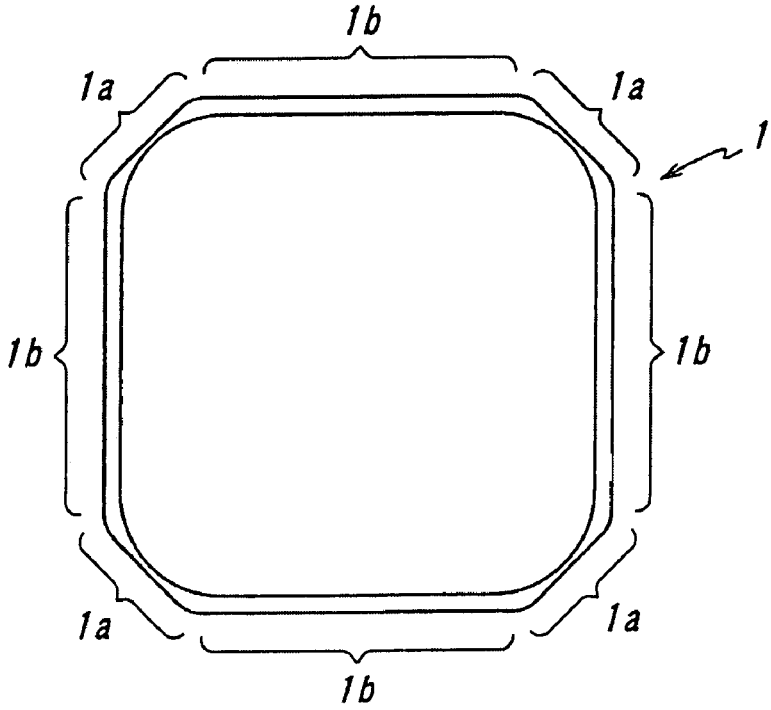
FIG. 3 is a sectional view along the line III-III in FIG. 1.

In FIGS. 1 to 3, reference numeral 1 denotes the body of a bottle-shaped container according to the present invention. The container body 1 comprises a trunk having a square cross-section that is defined by four corner pillar portions 1*a* and walls 1*b* joining the adjacent pillar portions 1*a*. Reference numeral 2 denotes a waist, which divides the trunk of the container body 1 into two sections, i.e., upper and lower sections. The waist 2 comprises a circumferential groove having an arcuate groove wall 2*a* that projects convexly inwards of the container and extends with a constant radius of curvature R at least in the pillar portions 1*a*.

Figure 4:
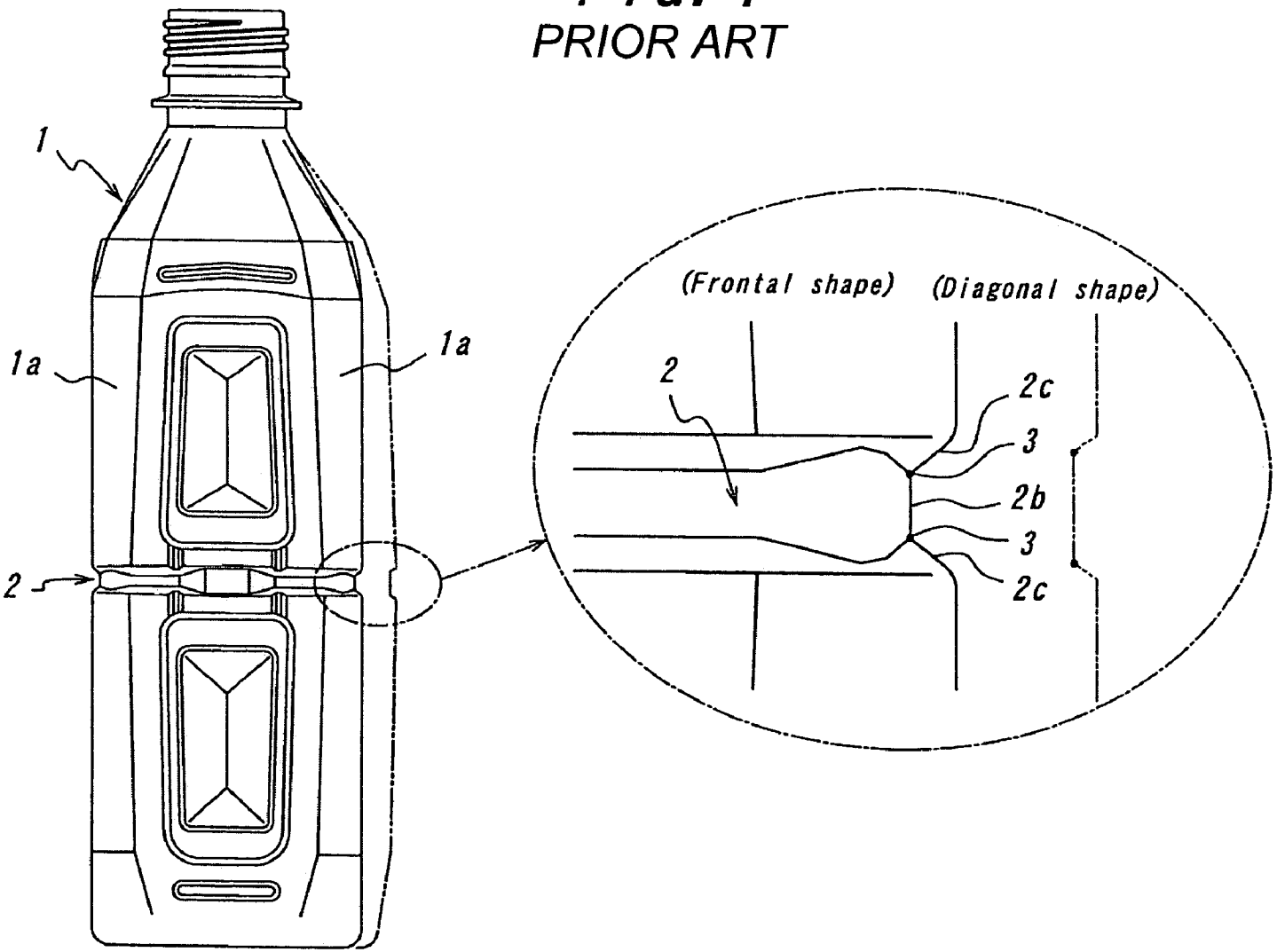
FIG. 4 PRIOR ART
FIG. 4 is a side view of a conventional square-sectioned container.

In the case of conventional square-sectioned synthetic resin bottle, of which the relevant part is shown in FIG. 4, it has been customary for the waist portion 2 at each pillar portion 1*a* to have a trapezoidal profile defined by a groove base 2*b* and groove walls 2*c*, with inflections 3 at their junction. When such a bottle is applied with a load from the mouth portion downwards, stresses tend to concentrate at the inflections 3, causing buckling of the container starting from such inflection 3.

Figure 5:
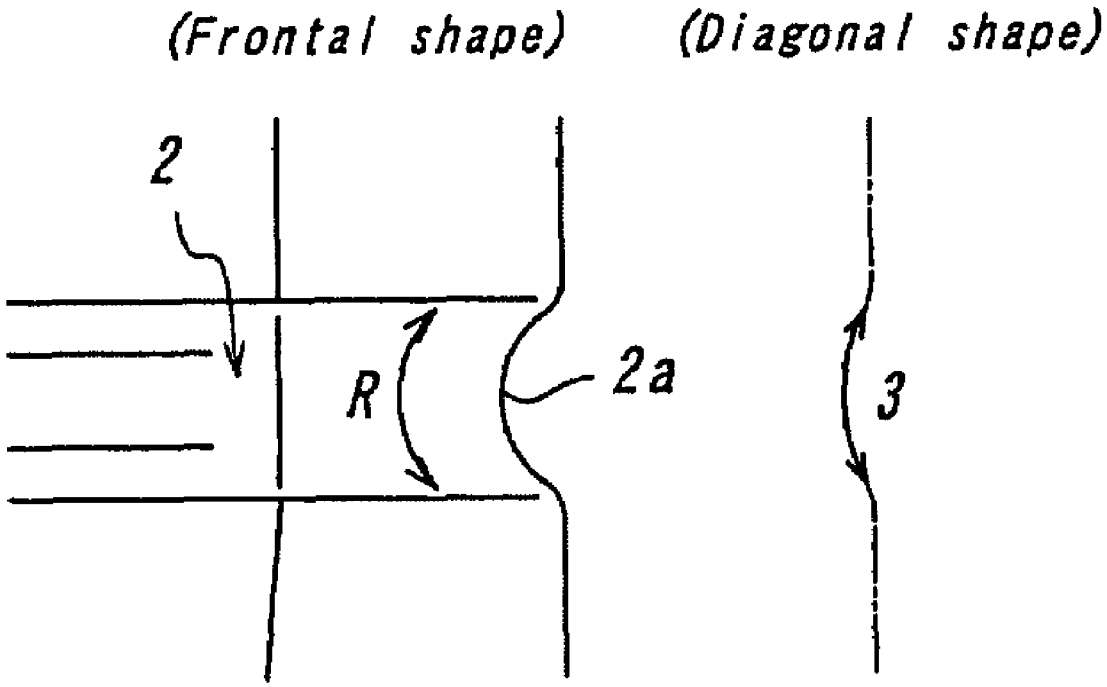
FIG. 5 is the enlarged view showing the relevant part of the container shown in FIG. 1.

In contrast, according to the present invention, the waist 2 at each pillar portion has an arcuate profile 2*a* with a constant radius of curvature R, as can be appreciated from FIG. 5 which shows the waist portion 2 in enlarged scale. Thus, even if a load is applied to the bottle from the mouth portion downwards, stresses are distributed at the waist to effectively prevent buckling of the bottle. The waist 2 at the corner pillar portion 1*a* has inflections 3 with an arcuate profile that is bulged outwards with a constant radius of curvature.

EXAMPLE

To demonstrate effectiveness of the present invention, a test bottle of 500 ml in volume (FIG. 6) according to the present invention and a conventional bottle of 500 ml in volume (FIG. 4) were prepared, using 26.5 g of the same synthetic resin Each bottles were applied with loads from the mouth portion downwards, to investigate the load under which buckling occurs.

Figure 6:
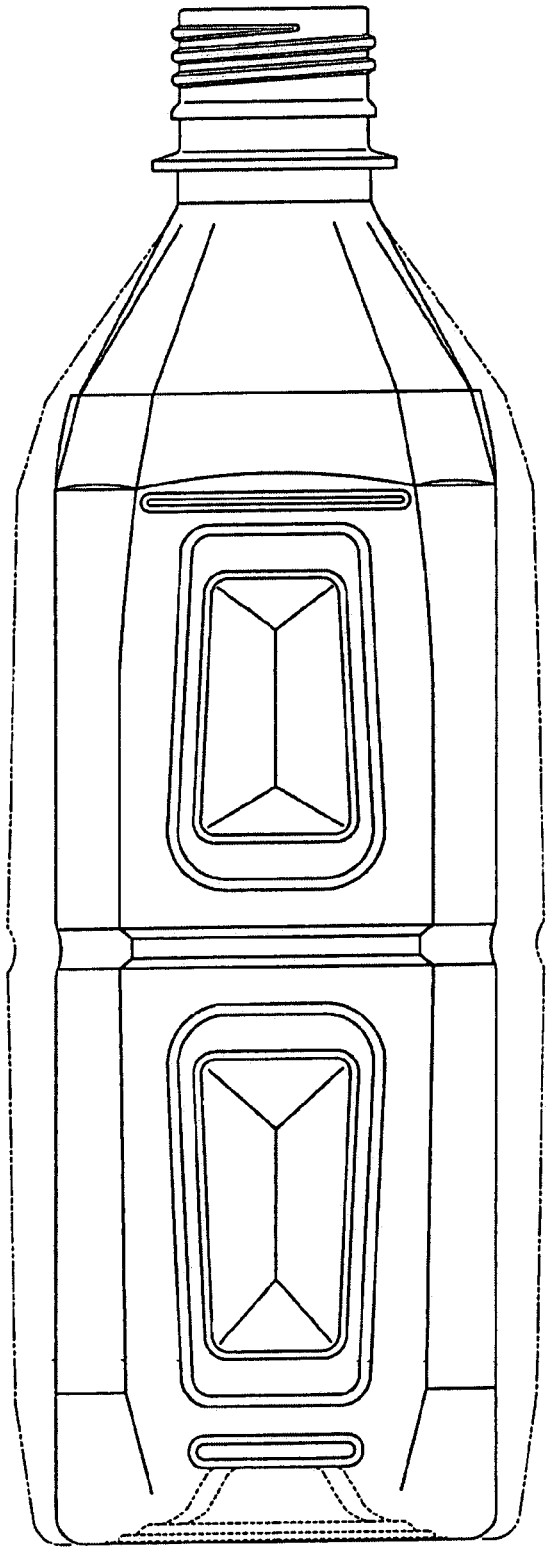
FIG. 6 is a side view of a square-sectioned container according to another embodiment of the present invention.
Figure 7:
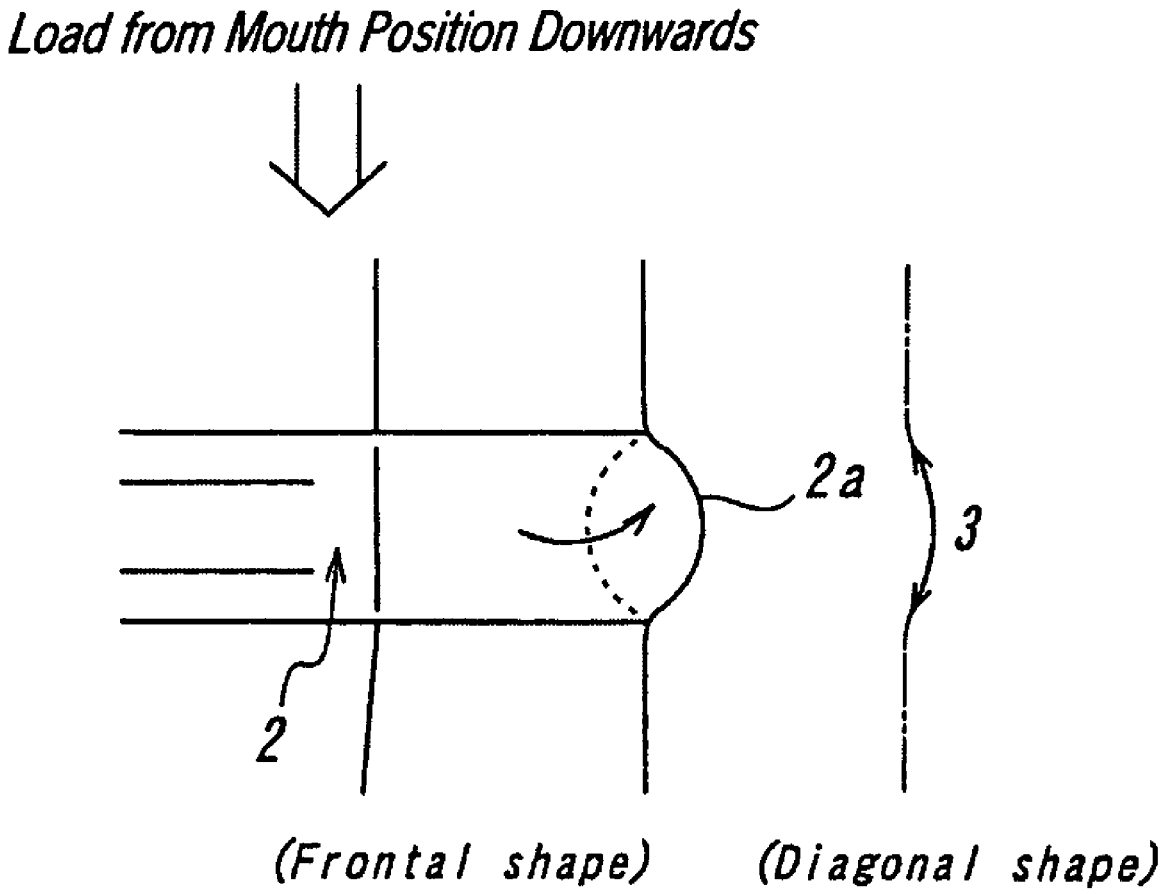
FIG. 7 is an enlarged view showing the relevant part of the container shown in FIG. 1 in response to a load from the mouth portion downward.

The test revealed that buckling of the test bottle shown in FIG. 6 occurs under a load of 396 N (forced shift being 2.3 mm), whereas buckling of the control bottle shown in FIG. 4 occurs under a load of 324 N (forced shift being 2.9 mm). The test demonstrates the effectiveness of the present invention wherein the waist portion has an arcuate profile at the corner pillar portion.

Incidentally, investigation of the buckling load has been made by preparing the bottle of FIG. 4 using 32 g of the synthetic resin, and it has been revealed that buckling of such bottle occurs under a load of about 617 N.

According to the present invention, the waist portion has an arcuate profile at least at the corner pillar portion, so that even when a load is applied to the container from the top, stresses occurring at the waist are effectively distributed to significantly improve the strength (buckling strength) of the container and reduce the amount of resin to be used for each container.

The invention claimed is:

1. A square-sectioned synthetic resin container comprising a body having a square cross-section defined by four corner pillar portions and four flat walls joining the adjacent pillar portions, said body being provided with a waist for dividing the body into at least upper and lower sections, wherein:

said waist comprises a circumferential groove having a trapezoidal profile that protrudes convexly inwards of the container; and said groove has an arcuate groove wall at least at said pillar portion.

2. The container according to claim 1, wherein said arcuate profile of the groove wall has a constant radius of curvature R.

3. The container according to claim 2, wherein said pillar portion has an inflection at a transition to said waist, said inflection having an arcuate profile that projects convexly outwards.

4. The container according to claim 2, wherein said container has thinned walls.

5. The container according to claim 1 wherein said pillar portion has an inflection at a transition to said waist, said inflection having an arcuate profile that projects convexly outwards.

6. The container according to claim 5, wherein said container has thinned walls.

7. The container according to claim 1, wherein said container has thinned walls.

8. The container according to claim 7, wherein, with reference to the container having a volume of 500 ml, the amount of the synthetic resin used is about 26.5 g.

* * * * *